United States Patent [19]

Hudspith

[11] 4,434,823

[45] Mar. 6, 1984

[54] LIQUID TRANSFER DEVICE

[75] Inventor: Sydney Hudspith, La Crescenta, Calif.

[73] Assignee: American Hospital Supply Corporation, Evanston, Ill.

[21] Appl. No.: 278,549

[22] Filed: Jun. 29, 1981

[51] Int. Cl.[3] ..... B65B 3/04

[52] U.S. Cl. ..... 141/329; 141/59; 141/383; 141/389; 137/636.1; 251/6; 285/137 R; 604/413

[58] Field of Search ..... 141/4–8, 141/59, 279, 382–389, 19, 67, 329, 330; 251/6; 137/636, 636.1; 285/137 R, 362, 377; 128/214.2, 272.3, 276; 604/264, 268, 269, 318–321, 7, 411, 412, 413, 22, 31, 49, 73, 119, 120, 131, 245

[56] References Cited

U.S. PATENT DOCUMENTS

| | | | |
|---|---|---|---|
| 2,409,343 | 10/1946 | Curtis | 128/214 R |
| 2,682,874 | 7/1954 | Hickey | 128/214.2 |
| 2,825,333 | 3/1958 | Broman | 128/214 R |
| 3,000,540 | 9/1961 | Wheeler | 141/330 |
| 3,533,439 | 10/1970 | Hall | 251/6 |
| 3,726,795 | 4/1973 | Edwards | 141/330 |
| 3,938,520 | 2/1976 | Scislowicz et al. | 141/330 |
| 4,201,208 | 5/1980 | Cambio | 128/214.2 |
| 4,211,588 | 7/1980 | Raines | 285/137 R |

FOREIGN PATENT DOCUMENTS

| | | | |
|---|---|---|---|
| 201029 | 1/1966 | Sweden | 128/214.2 |

*Primary Examiner*—Houston S. Bell, Jr.
*Attorney, Agent, or Firm*—Roger A. Williams

[57] ABSTRACT

A liquid transfer device is disclosed which comprises a body having a wall defining a cavity within the body. Two hollow conduits extend from the cavity through the wall and project outwardly from the body. Two resilient tubes extend through the body and are attached in fluid flow communication to each of the hollow conduits. A roller clamp is provided within the cavity of the body for selectively applying or releasing compressive force on the resilient tubes to selectively permit or prevent fluid flow through such resilient tubes. A double lumen needle is attached to the body such that the needle engages the two hollow conduits projecting outwardly from the body. Each lumen within the needle is in fluid flow communication with one of the hollow conduits and thereby one of the resilient tubes. One of the resilient tubes is connected at its distal end to a liquid source to be transferred. The remaining resilient tube is connected at its distal end to a vacuum source.

16 Claims, 5 Drawing Figures

28
32
30
48
44
45
48
30
50

3
42
40
22
44
10
24

3
14
20
12
16
18
TO VACUUM

LIQUID TRANSFER DEVICE

BACKGROUND OF THE INVENTION

The invention herein relates to a liquid transfer device having a utility for transferring a liquid of choice from one container to another in a sterile manner. In particular, the liquid transfer device can be used to reconstitute or formulate "piggybacks."

In the administration of intravenous solutions to recipients, there is a need in many instances to supplement the particular solution being administered. When such is the case, the supplemental solution can be administered simultaneously with the I.V. solution by placing a second container or vial having the supplemental solution (called a piggyback) in parallel with the I.V. solution. The piggyback is located such that the piggyback solution is in fluid flow communication with the administration tubing for the I.V. solution. For example, the tubing from the I.V. solution and piggybacksolution can be connected through a suitable Y or T-connector leaving the third tubing connected to such a connector leading to the recipient of the solutions.

The piggyback bottles are supplied to the pharmacy in generally a sterile condition with the drug to be administered in a dry powder or lyophilized state. Thus prior to use, the drugs in the piggyback bottles must be reconstituted by the addition of a proper diluent or solvent. Such a diluent or solvent can be withdrawn from an I.V. bottle. Considerable effort and time is expended by the pharmacist in reconstituting the piggybacks. One currently practiced technique for reconstituting such piggybacks is performed by introducing the solvent to the piggyback bottle using a syringe. A syringe is utilized in order to pierce the seal on the piggyback bottle, which seal is similar to the seals on I.V. bottles. One drawback with such a technique is that the piggyback bottles are generally not evacuated and therefore it is difficult to introduce any signficant volume of solvent to the bottle. In such a technique, a vent needle has also been inserted through the seal on the piggyback bottle in order to vent the atmosphere within the bottle so as to permit the introduction of the solvent. A disadvantage of such a technique is that the technique is costly as the vent needles and syringes are expensive and considerable time and effort is required to insert a syringe and vent needle in each of the piggyback bottles to be reconstituted. In many of the larger hospitals, a pharmacist may be called upon to fill or reconstitute hundreds of such piggybacks during the course of a day.

Another technique which is currently available to the pharmacist for reconstituting piggybacks is a rapid fill system utilizing a double lumen needle. One of the lumens of the needle is connected in fluid flow communication with the solvent while the other luman of the needle provides a vent to the atmosphere for the air within the piggyback bottle. While such a device solves some of the problems of the earlier described technique, it has a drawback in that the time required to introduce a solvent to a particular piggyback bottle is dependent upon the atmosphere within the piggyback bottle being forced out of the bottle through the venting lumen of the needle. Thus, considerable time is still expended when a significant number of piggyback bottles are to be reconstituted.

It would be desirable to have a device which can be operated with one hand that would permit the rapid introduction of a solvent to piggyback bottles and which avoid the opportunity for contamination of the contents of the piggyback bottle during such reconstitution procedure.

SUMMARY OF THE INVENTION

The apparatus herein provides for the rapid introduction of a solvent to a piggyback bottle such that a significant number of such bottles can be reconstituted in a relatively short period of time. The apparatus can be operated with one hand, freeing the other hand of a pharmacist to cap the immediately previously reconstituted piggyback bottle.

A liquid transfer device is herein provided which has a body having a wall defining a cavity within the body. Two hollow enclosed conduits extend from the cavity through the wall and project outwardly from the body. Two resilient tubes extend through the body and cavity with each tube being attached at its proximal end to one of the hollow conduits. Thus, the resilient tubes are in fluid flow communication with the hollow conduits.

A clamp is provided within the body for selectively applying or releasing compressive force on the resilient tubes extending through the cavity. The clamp can be actuated to selectively permit or prevent fluid flow through the resilient tubes. The clamp can be a roller clamp having a cam which can compress the resilient tubes against a surface within the cavity to prevent fluid flow through the resilient tubes upon rolling the roller. The perimeter of the roller can extend beyond the body of the liquid transfer device through a suitable opening to enable activation of the roller.

A double lumen needle is attached to the body such that the needle engages the two hollow conduits projecting outwardly from the body and which are in fluid flow communication with the tubes. Thus, the double lumen needle is in fluid flow communication with the resilient tubes. The double lumen needle can be releasably attached to the body of the liquid transfer device such that the needle can be replaced to provide for reuse of the liquid transfer device itself.

A double lumen needle is utilized such that one lumen of the needle provides for introduction of the solvent to the piggyback bottle and the other lumen of the needle provides for evacuation of the atmosphere present in the piggyback bottle. The introduction of the solvent is provided by connecting one of the resilient tubes extending from the body of the liquid transfer device to a container containing the solvent to be utilized. The connection to a bottle containing the solvent can also be a double lumen needle. The resilient tube extending from the liquid transfer device is connected to one of the lumens of the needle and a filter can be connected to the other lumen of the needle.

Evacuation of the atmosphere within the piggyback bottle can be accomplished by connecting the other resilient tube extending from the liquid transfer device to a vacuum source. A vacuum can then be applied which withdraws the atmosphere present within the piggyback bottle, thus increasing the flow rate of solvent to the piggyback bottle.

DETAILED DESCRIPTION OF THE INVENTION

Figures 1, 3:
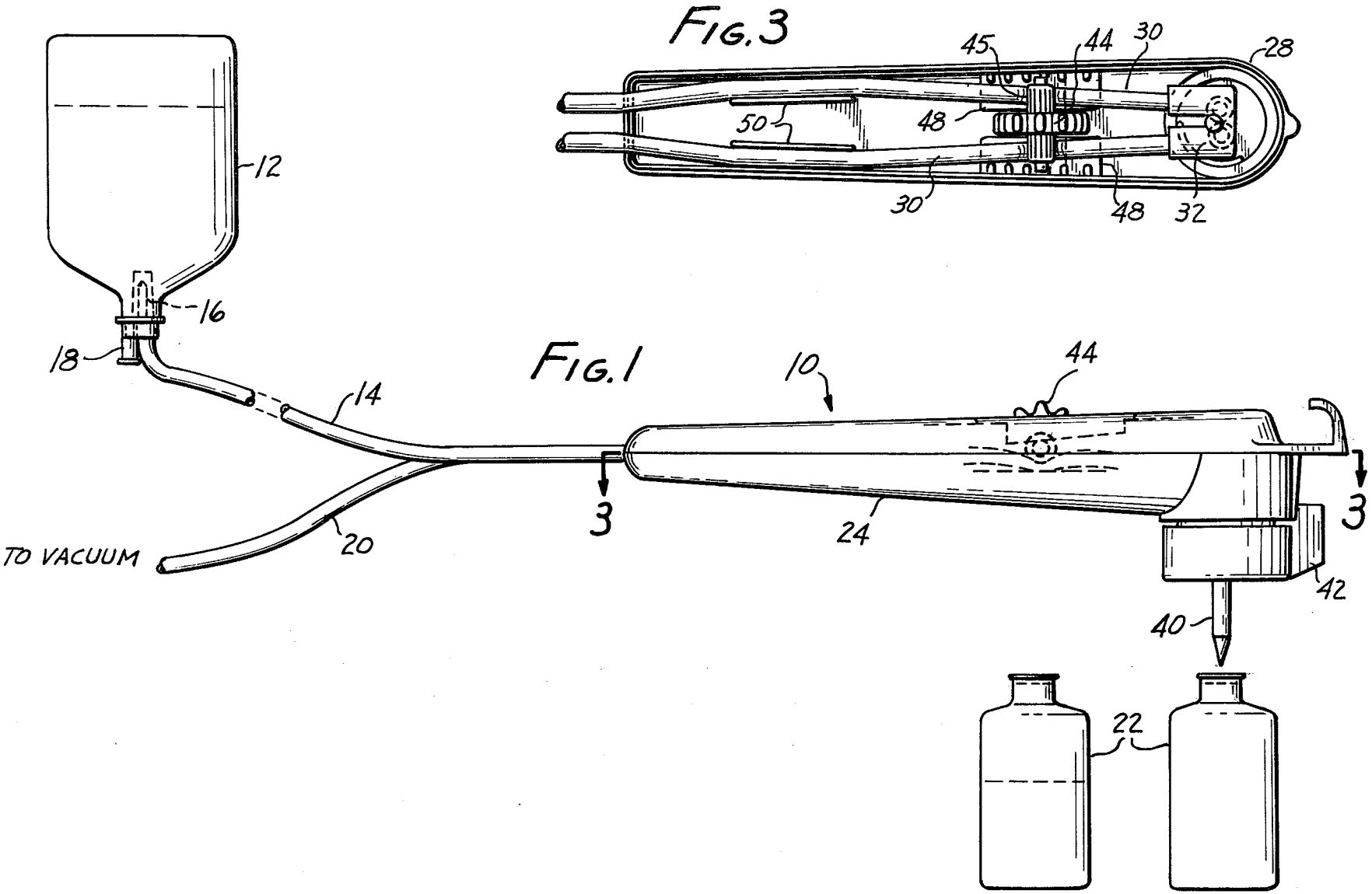
FIG. 1 is an elevational view of a liquid transfer system illustrating the utility of the device herein for reconstituting piggybacks.
FIG. 3 is a view of the embodiment of the liquid transfer device taken along line 3—3 of FIG. 1.

A liquid transfer system for use in transferring liquid from one container to another sealed container is illustrated in FIG. 1. In particular, the liquid transfer system includes a liquid transfer device 10 and a source for liquid to be transferred, such as an I.V. bottle 12. Other sources, such as a collapsible bag, could be utilized as the source for the liquid to be transferred rather than the I.V. bottle 12.

The liquid transfer device 10 is connected to the liquid source through a resilient first tubing 14. The liquid transfer device is in fluid flow communication with the I.V. bottle through such first tubing. At the distal end of the first tubing 14 can be a double lumen needle 16 which is inserted through the seal of the I.V. bottle. One of the lumens of the double lumen needle is in fluid flow communication with the first tubing. The second lumen of the double lumen needle is in fluid flow communication with the atmosphere through a suitable filter 18. The filter permits the inflow of filtered air into the I.V. bottle to avoid the formation of a vacuum therein as the liquid or solution is drained from the I.V. bottle.

A second tubing 20 also extends from the liquid transfer device 10. Such a second tubing is connected to a vacuum source (not shown). Such a vacuum source can be any suitable device capable of providing a vacuum. For example, a vacuum pump or water aspirated vacuum source can be utilized. The reasoning for connecting such a second tubing to a vacuum source will be more fully described hereinafter.

The first and second tubing extend through a body 24 of the liquid transfer device and are connected to a double lumen needle 40 also attached to the body. The double lumen needle can pierce the seal on a piggyback bottle 22. After having pierced the seal on such a bottle, the liquid desired to be transferred can be introduced to the piggyback bottle. The liquid to to be transferred, such as a solvent for the drug present in the piggyback bottle, is transferred through the first tubing 14 and through one of the lumens in the double lumen needle 40. A vacuum or partial vacuum is created in the piggyback bottle 22 through the second lumen in the double lumen needle and through the second tubing 20 connected to a vacuum source. Both the vacuum and flow of liquid can be controlled on the body of the liquid transfer device by a suitable clamp, such as a roller clamp shown in part as element 44 of FIG. 1. The roller clamp can be activated to selectively permit or prevent a vacuum from being drawn through the second tubing 20 or fluid flow through the first tubing 14. The operation of the roller clamp 44 will be more fully detailed hereinafter.

Figure 2:
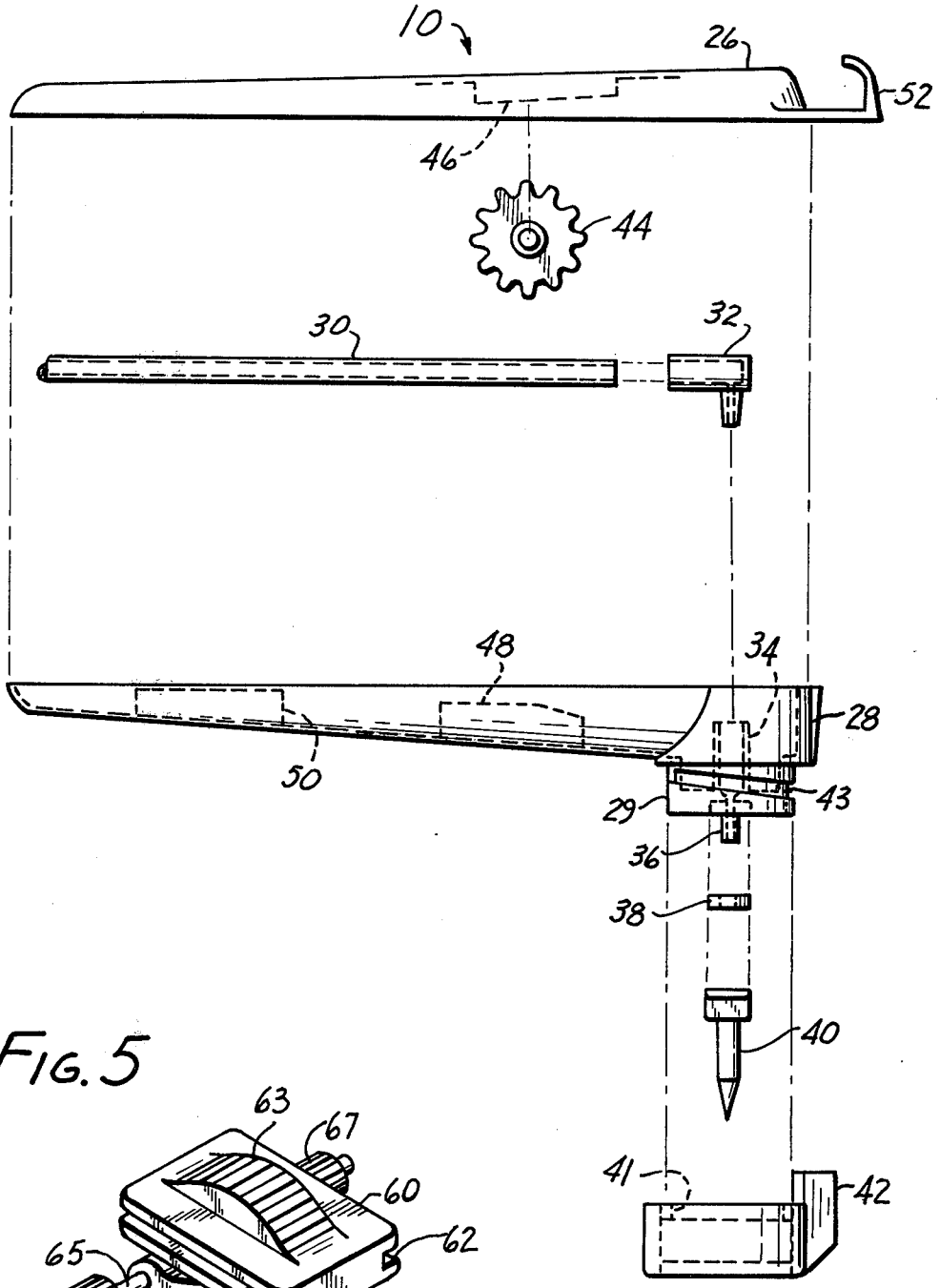
FIG. 2 is an elevational exploded view of an embodiment of the liquid transfer device herein.

The liquid transfer device 10 is more fully illustrated in the exploded view shown in FIG. 2. The liquid transfer device includes a body 24 which can have a first portion 26 and a second portion 28. The body is elongated forming a handle that readily fits in the user's hand. The body can be formed of any suitable material, such as a plastic, and can be injection molded using conventional injection molding techniques.

Figure 4:
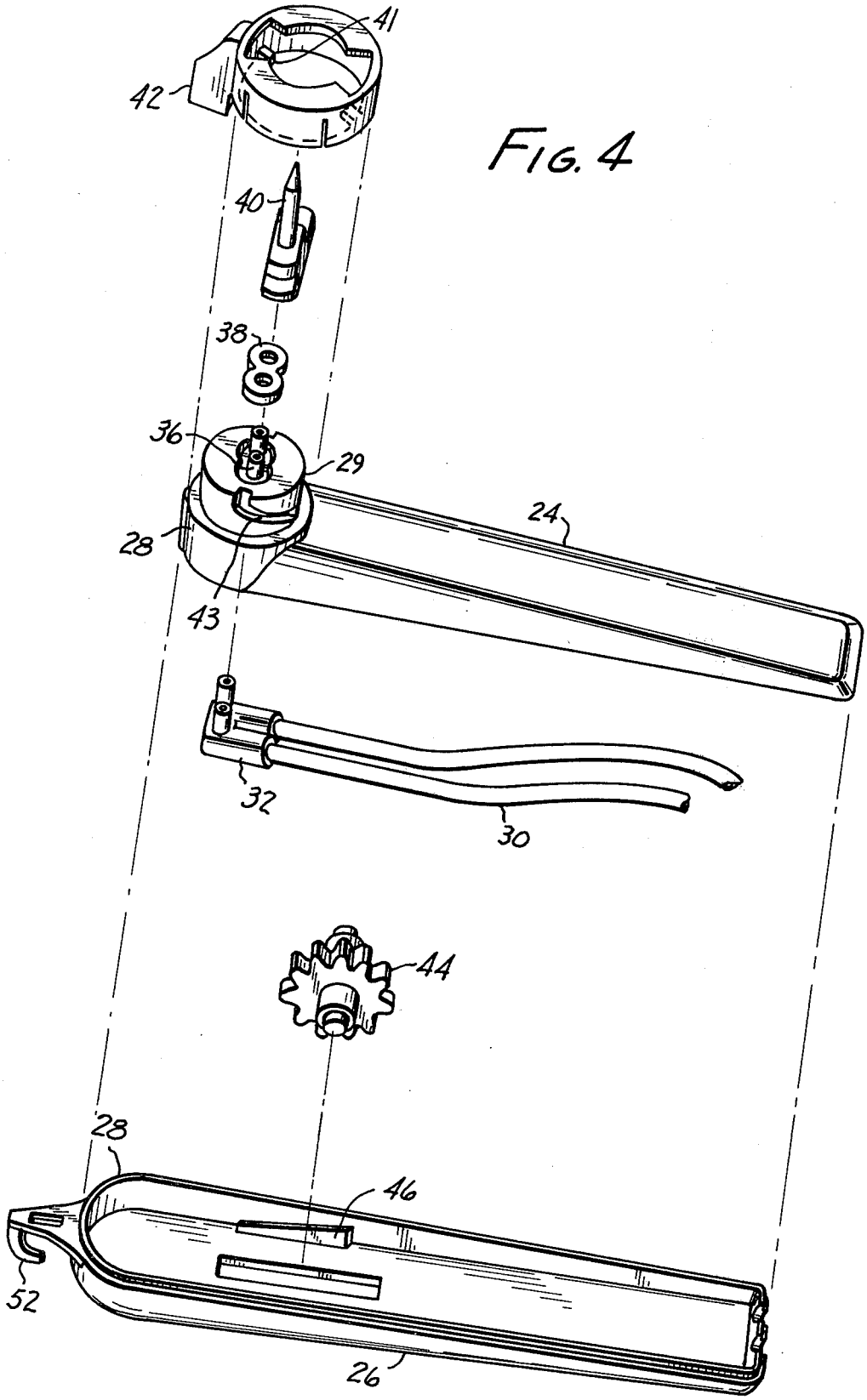
FIG. 4 is an exploded perspective view of an embodiment of the liquid transfer device showing the arrangement of elements within the device.

With regard to FIGS. 2 and 4, the first portion 26 of the body has a generally concave form formed by the wall of the body. Within the concave cavity formed in the first portion of the body are positioned inclined planes 46 which form a track for the roller 44. The inclined planes lie along the wall of the first portion of the body and are secured to the body. The slope of the inclined planes can be in either direction, however, the slope of both of the inclined planes 46 are in the same direction such that operation of the roller clamp either opens or closes the first and second tubing at the same time.

With reference to FIGS. 2 through 4, the second portion 28 of the body also has a cavity therein created by the wall of the body. Both the first and second portions of the body are designed to mate together to form the body or handle for the liquid transfer device. The second portion 28 includes a generally cylindrical end and projection 29. The cylindrical end and projection extends from the body such that an angle is formed between an axis of the cylindrical end portion and a longitudinal axis of the body. In the embodiment illustrated, for example, the angle is about 90°.

Two tubular conduits 34 are positioned within the cylindrical end of the second portion. The two tubular conduits extend through the walls of the body and project outwardly of the body at projections 36 and 37. The tubular conduits project outwardly of the body in order to engage a double lumen needle 40. The double lumen needle 40 can be releasably attached to the body of the liquid transfer device.

The double lumen needle provides for both delivery of liquid to the piggyback bottle to be filled and creation of a vacuum within the piggyback bottle. The lumens of the double lumen needle have the same inner diameter and are spaced symmetrically about a center axis extending through the double lumen needle. The openings for the lumens are spaced adjacent the tip of the needle and extend longitudinally in generally a parabolic configuration along the needle, terminating at about the locus of tapering for the penetrating tip of the needle. Such a double lumen needle is preferred as it has been found to prevent bridging of fluid or the lyophilized or powdered substance in a piggyback bottle into the lumen providing a vacuum to the piggyback bottle.

The double lumen needle is attached in a leak proof connection with the projections 36 and 37 using a seal or gasket 38. Generally, the seal or gasket 38 is constructed of a resilient material which can be compressed to form a leak proof seal between the double lumen needle 40 and the projections 36 and 37. The double lumen needle is attached to the liquid transfer device such that one of the lumens of the needle is in fluid flow communication with one of the projections 36 or 37 and the remaining lumen of the needle is in fluid flow communication with the other projection.

A cap 42 can be adapted to secure the double lumen needle to the generally cylindrical end 29 of the second portion of the body of the liquid transfer device. In a preferred working embodiment, the cap is threaded for engaging threads 43 on the generally cylindrical end. The cap is chamfered to apply pressure against a base of the double lumen needle 40 to exert a force against the double lumen needle such that the needle tightly engages the projections 36 and 37. The chamfer provided on the cap is generally designated as 41 in FIG. 2. By rotating the cap 42, a force can either be exerted or removed from the double lumen needle so as to make the double lumen needle removable. The double lumen needle can be attached to the liquid transfer device without contaminating or comprising sterility of the needle. The double lumen needle can be provided with a detachable needle guard. The needle guard can be grasped while inserting the double lumen needle on the liquid transfer device. After the base of the needle is inserted through the cap to engage the projections 36 and 37, the cap can be rotated, securing the double lumen needle in a leakage proof real to the liquid transfer device. The protective needle guard can then be removed. An advantage of the configuration of the double lumen needle herein is that no care with regard to positioning particular lumens is necessary when attaching the needle to the liquid transfer device. Another advantage of the method of attaching the double lumen needle herein is that the needle does not become "frozen" during or after use, such as can occur with conventional twist-type locking needle fittings.

Within the cavity of the body extend the first and second tubing 14 and 20. In FIGS. 2 through 4, such resilient tubing is designated as 30. With regard to the body 24 of the liquid transfer device, there need be no distinguishing between the first and second tubing. That is, the resilient tubing extends through the body and the proximal end of each of the tubings connect to an elbow 32. The elbow 32 is an elbow having two flow channels therethrough. Each flow channel connects to the proximal end of one of the tubes 30 extending through the body. Projections on the elbow 32 are designed to engage the tubular conduit 34. Thus, fluid flow communication with each of the lumens of the double lumen needle is established with either the first or second resilient tubing. As both the resilient tubes have fluid flow communication with the double lumen needle, there is no requirement that each of the resilient tubes be specifically identified within the body of the liquid transfer device.

Also within the body 24 of the liquid transfer device is a clamp, such as a roller clamp having a roller 44. The roller 44 is equipped with a pair of cylindrical cams 45 and is adapted for operating selectively with inclined planes 46 within the first portion of the body. That is, the cams 45 engage the inclined planes 46. A slot 49 is formed within the first portion of the body. The roller 44 is of a sufficient diameter that a portion of the perimeter of the roller extends outwardly of the body through the slot 49. The operator of the liquid transfer device can thereby selectively position the roller 44 by rolling it along the inclined planes 46. Within the cavity of the second portion of the body are positioned two compression blocks 48. The tubing 30 extending through the cavity lies against the compression blocks. The cams 45 on the roller also engage the tubing 30 opposite such compression blocks 48. As the roller 44 traverses the inclined plane 46, it exerts a compressive force against the tubing 30 (shown partially in phantom in FIG. 1). By selectively positioning the roller 44 along the inclined planes, fluid flow through the tubing 30 can either be permitted or prevented. The spacing between the compression blocks 48 and inclined planes 46 is sufficient to permit fluid flow or prevent fluid flow through the tubing 30 when the roller 44 traverses the inclined plane 46.

Figure 5:
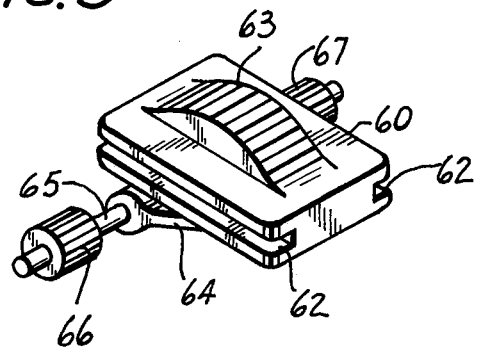
FIG. 5 is a perspective view of an embodiment of a clamping device.

The clamp can be any other suitable clamping device. An embodiment of an alternative clamping device is illustrated in FIG. 5. With reference to FIG. 5, the clamping device can be a slide-activated clamp 60. The slide-activated clamp has grooves 62 for engaging the wall of the first portion 26 of the body. A thumb or finger gripping surface 63 can extend through the slot 49. Mounted on the clamp 60 can be an axle support 64 and corresponding axle 65. Cams 66 and 67 can be provided on the axle, which cams can engage the resilient tubing extending through the liquid transfer device in a similar manner as do the cams 45 in the embodiment of FIGS. 1–4 as the clamp slides.

Also, within the cavity of the second portion of the body can be located tubing guides 50. The tubing guides 50 comprise interior walls fastened to the body. Such tubing guides 50 can assist in the maintaining of the tubing 30 in a position on the compression block such that the cams 45 of the roller evenly engage the tubing.

The liquid transfer device can also be adapted with a hanger 52. The hanger 52 can be an angled projection as is shown in the drawings and can include an opening. Thus, the liquid transfer device can be hung on a hook during its use.

The liquid transfer device is used by first connecting a first resilient tubing to a source of liquid to be transferred. For example, such a first tubing can be connected to an I.V. bottle as is detailed in FIG. 1. The roller is positioned to prevent fluid flow through the tubing within the liquid transfer device. The second resilient tubing is connected to a suitable vacuum source and the vacuum source is activated. The piggyback bottles to be reconstituted are aligned and their protective outer capings removed. The double lumen needle 40 of the liquid transfer device is inserted into the first piggyback bottle. After or upon insertion, the roller is rolled to create fluid flow through the tubing 30. As fluid flow is permitted through the tubing 30, a vacuum is created within the piggyback bottle and liquid flow into the bottle occurs concomitantly. As can appropriate amount of the liquid is introduced into the piggyback bottle, the roller can again be activated to prevent fluid flow through the tubing 30, thus stopping the introduction of fluid to the piggyback bottle and breaking the vacuum created in the piggyback bottle. The liquid transfer device can then be inserted into the next piggyback bottle to be reconstituted.

It can be noted that the operation of this liquid transfer device described herein can be accomplished with one hand. Thus, the second hand of the operator is free either to remove caps from bottles to be filled or to cap bottles previously filled. The liquid transfer device herein described also increases efficiency of the pharmacist as the vacuum created in the piggyback bottles decreases the amount of time required to reconstitute the piggyback administration systems. The liquid transfer device provides for the transfer of a liquid in a substantially sterile manner which avoids or prevents contamination of the liquid being transferred. The liquid transfer device is easy to operate and can be provided with a reusable function in view of the replaceability and discardability of the double lumen needle used to insert into the piggyback bottles. Such a double lumen needle can be removed from the liquid transfer device and exchanged for a new double lumen needle when required and without compromising sterility of the needle.

I claim:

1. A liquid transfer device comprising:

a body having a wall defining an enclosed cavity within the body;

two hollow conduits extending from the cavity through the wall and projecting outwardly from the body;

two lengths of resilient tubes having at least a portion thereof extending through the body and each attached in fluid flow communication at its proximal end within the body to one of the hollow conduits;

means within the enclosed cavity but actuated from outside the body for selectively applying or releasing compressive force simultaneously on the resilient tubes to selectively permit or prevent fluid flow through such resilient tubes; and a double lumen needle attached to the body and engaging the portions of the two hollow conduits projecting outwardly from the body such that each lumen within the needle is in fluid flow communication with one of the hollow conduits.

2. A liquid transfer device as recited in claim 1 wherein the means for selectively applying or releasing compressive force comprises:

a compression block within the cavity of the body which is in contact with a length of each resilient tube extending through the body;

a roller clamp mounted within the cavity having cams which engage the resilient tubes; and inclined planes within the cavity inclined in a common direction upon which the roller can travel to compress the resilient tubes between the roller cams and compression block.

3. A liquid transfer device as recited in claim 1 further comprising means within the cavity for maintaining the resilient tubes spaced apart and between the roller cams and compression block.

4. A liquid transfer device as recited in claim 3 wherein the means for maintaining the resilient tubes spaced apart comprise interior walls within the cavity.

5. A liquid transfer device as recited in claim 1 further comprising means for releasably attaching the double lumen needle to the body.

6. A liquid transfer device as recited in claim 5 wherein such means for releasably attaching the double lumen needle to the body comprises a rotatable cap adapted to secure to the body, the cap having a chamfer which on rotating the cap engages the double lumen needle.

7. A liquid transfer device as recited in claim 1 further comprising means attached to the distal end of one of the resilient tubes for connecting the tube to a liquid supply source.

8. A liquid transfer device as recited in claim 7 wherein said means for connecting the tube to a liquid supply source comprises a double lumen needle.

9. A liquid transfer device as recited in claim 1 or 7 further comprising means attached to the distal end of one of the resilient tubes for connecting the tube to a vacuum source.

10. A liquid transfer device comprising:

a body having a wall defining and enclosing a cavity within the body;

two hollow conduits extending from the cavity through the wall with at least a portion of each conduit projecting outwardly from the body;

two lengths of resilient tubing wherein the proximal end of each tubing extends through the body and is attached in fluid flow communication to one of the hollow conduits within the cavity of the body;

two inclined planes commonly inclined, spaced apart and fastened within the cavity of the body;

two compression blocks secured to the body within the cavity, spaced apart and spaced from the inclined planes;

a roller clamp having at least a portion thereof extending through the wall of the body, which roller clamp is adapted to travel between the inclined planes and compression blocks having two cams which engage the inclined planes and the two resilient tubes extending through the body such that travel of the roller along the inclined planes exerts a compressive force simultaneously against the resilient tubes; and a double lumen needle releasably attached to the body and engaging the outwardly projecting portions of the two hollow conduits such that each lumen within the needle is in fluid flow communication with a resilient tube extending through the body.

11. A liquid transfer device as recited in claim 10 wherein the body comprises a first and second portion and the inclined planes are attached within and to the first portion and the compression blocks are attached within and to the second portion of the body.

12. A liquid transfer device as recited in claim 11 wherein the first portion of the body has a slot extending through the wall through which at least a portion of the roller projects.

13. A liquid transfer device as recited in claim 10 further comprising means within the cavity for maintaining the resilient tubes between the cams on the roller and compression blocks.

14. A liquid transfer device as recited in claim 13 wherein such means for maintaining the resilient tubes between the cams of the roller and compression blocks comprises two interior walls attached to the wall of the body and spaced therefrom forming a channel in the cavity through which the resilient tubing passes.

15. A liquid transfer device as recited in claim 10 further comprising an elbow connector within the cavity having two separate flow channels therethrough and connected to the resilient tubing and connected to the two hollow conduits to provide fluid flow between a tubing and a conduit.

16. A liquid transfer device as recited in claim 2 or 10 wherein the roller clamp comprises a slide-activated clamp slidably attached to the body of the liquid transfer device and having axially mounted thereon cams which engage the resilient tubes.

* * * * *